US006234579B1

(12) United States Patent
Montgomery, Jr.

(10) Patent No.: US 6,234,579 B1
(45) Date of Patent: May 22, 2001

(54) CUTTING TOOL HOLDER RETENTION ASSEMBLY

(75) Inventor: Robert H. Montgomery, Jr., Everett, PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/287,842

(22) Filed: Apr. 7, 1999

(51) Int. Cl.[7] ..... E21C 35/19
(52) U.S. Cl. ..... 299/106; 299/102
(58) Field of Search ..... 299/102, 103, 299/106, 107, 109; 37/455, 456, 465

(56) References Cited

U.S. PATENT DOCUMENTS

| | | | | |
|---|---|---|---|---|
| 2,082,283 | * | 6/1937 | Godfrey | 299/103 X |
| 3,749,449 | | 7/1973 | Krekeler . | |
| 4,057,294 | | 11/1977 | Krekeler . | |
| 4,154,483 | * | 5/1979 | Hollingworth | 299/109 X |
| 4,282,665 | * | 8/1981 | Fletcher et al. | 299/109 X |
| 4,302,055 | | 11/1981 | Persson . | |
| 4,609,227 | | 9/1986 | Wild et al. . | |
| 4,650,254 | | 3/1987 | Wechner . | |
| 4,744,605 | | 5/1988 | Komotzki . | |
| 4,762,372 | | 8/1988 | Rassmann et al. . | |
| 4,903,420 | * | 2/1990 | Kreitzberg et al. | 299/103 X |
| 5,029,944 | | 7/1991 | Komotzki . | |
| 5,322,351 | | 6/1994 | Lent . | |
| 5,378,050 | | 1/1995 | Kammerer et al. . | |
| 5,605,382 | | 2/1997 | Massa | 299/107 |
| 5,683,144 | | 11/1997 | Kammerer et al. . | |
| 5,743,031 | * | 4/1998 | Launder et al. | 37/455 |
| 5,769,505 | | 6/1998 | Siddle et al. | 299/102 |

FOREIGN PATENT DOCUMENTS

| | | | |
|---|---|---|---|
| 657 194 | | 6/1965 | (BE) . |
| 1 224 502 | | 7/1987 | (CA) . |
| 23 19 619 | | 12/1974 | (DE) . |
| 32 43 583 | | 5/1984 | (DE) . |
| 3317146 | | 11/1984 | (DE) . |
| 34 34 348 | | 2/1986 | (DE) . |
| 3439508 | * | 3/1986 | (DE) . |
| 3531781 | * | 1/1987 | (DE) 299/103 |
| 40 15 022 | | 11/1990 | (DE) . |
| 9411545 | | 9/1994 | (DE) . |
| 29822369 | | 3/1999 | (DE) . |
| 29901986 | | 4/1999 | (DE) . |
| 934237 | * | 8/1963 | (GB) . |
| 1057830 | * | 2/1967 | (GB) . |

* cited by examiner

*Primary Examiner*—Eileen D. Lillis
*Assistant Examiner*—Sunil Singh
(74) *Attorney, Agent, or Firm*—Kevin P. Weldon

(57) ABSTRACT

An excavation cutting tool holder retention assembly includes a support block having a tool holder bore, the tool holder bore having a bore interior surface. The excavation cutting tool holder retention assembly also includes a cutting tool holder having a shank portion, the shank portion having a shank engagement surface. The excavation cutting tool holder retention assembly further includes a locking member forced between the bore interior surface and the shank engagement surface so as to frictionally retain the shank portion of the cutting tool holder within the tool holder bore.

37 Claims, 4 Drawing Sheets

30
28
26
32
36
4
34
46
18
96
24
80
22
98
86
88
82
50
90
44
52
84
59
54
10
20
48
4
64
68
64
74
72
70
12
60
14
62

CUTTING TOOL HOLDER RETENTION ASSEMBLY

TECHNICAL FIELD

This invention relates to excavation cutting tools, and more particularly a cutting tool holder assembly for retaining a cutting tool holder within a support block during use.

BACKGROUND ART

Excavation cutting tool assemblies for such applications as continuous mining or road milling typically comprise a cutting tool, sometimes referred to as a cutting bit, rotatably mounted within a cutting tool holder, sometimes referred to as a cutting tool sleeve, bit holder, or bit sleeve. In such assemblies, the cutting tool holder is mounted within a support block. The support block in turn is mounted onto a drum or other body, typically by welding, which in turn is driven by a suitable power means. When a number of such support blocks carrying cutting tool holders and cutting tools are mounted onto a drum or other body, and the drum or other body is driven, the cutting tools will engage and break up the material which is sought to be mined or removed. The general operation of such mining, road milling, or other such machines is well known in the art.

As mentioned, the cutting tool holder may be mounted within the support block, typically via some mechanical connection. For example, U.S. Pat. No. 5,322,351 to Lent (referred to as the Lent patent) discloses a cutting tool holder 42 mounted within a tool holder receiving pocket 28 of a support block, referred to in the Lent patent as a segment member 18, via a wedge member 46. The wedge member 46 is movably connected to the support block via an adjustable screw member 54. To use the apparatus disclosed in the Lent patent, a cutting tool holder 42 is disposed in the tool holder receiving pocket 28 such that the base portion of the tool holder mates with, and is located under, an inclined wall surface 24 within the receiving pocket 28. The wedge member 46 is then moved by tightening the adjustable screw member 54 such that the cutting tool holder 42 is held in place by the wedge member 46 and the inclined wall surface 24 of the receiving pocket 28 within the receiving pocket 28 of the support block.

As another example, U.S. Pat. No. 5,378,050 to Kammerer and Diessner (referred to as the Kammerer patent) discloses a chisel holder 30 having a neck 31 which may be inserted into a plug-in receptacle 21 of a support block, referred to as a basic part 20 in the Kammerer patent. The plug-in neck 31 has a recess 37 which defines a pressure surface 38. The pressure surface 38 faces a pressure screw 50 adjustably disposed in the support block, the basic part 20, so as to intersect the plug-in receptacle 21. The pressure screw 50 may be adjusted such that the pressure screw 50 protrudes into the recess 37 of the neck 31 of the chisel holder 30 and such that a retracting force is exerted on the pressure surface 38 of the chisel holder 30.

SUMMARY OF THE INVENTION

An object of the invention is to provide an improved cutting tool holder assembly which allows a cutting tool holder to be assembled within a support block.

In carrying out the above object, and other objects and features of the present invention, an improved excavation cutting tool holder retention assembly is provided. The improved excavation cutting tool holder retention assembly comprises a support block, cutting tool holder, and locking member. The support block has a tool holder bore, the tool holder bore having a bore interior surface. The cutting tool holder has a shank portion, the shank portion having a shank engagement surface. The locking member is forced between the bore interior surface and the shank engagement surface so as to frictionally retain the shank portion of the cutting tool holder within the tool holder bore.

In a preferred embodiment, the locking member has a wedge portion, the wedge portion having a bore adjacent surface and a shank adjacent surface, and at least one of the bore adjacent surface, shank adjacent surface, shank portion, and bore interior surface has a textured surface. In a more specific preferred embodiment, the textured surface is a serrated surface or a waved surface.

In another preferred embodiment, the locking member has a wedge portion, the wedge portion having a bore adjacent surface and a shank adjacent surface, and at least two of the bore adjacent surface, shank adjacent surface, shank portion, and bore interior surface which are in contact with each other has a textured surface. In a more preferred embodiment, the textured surfaces interlock. Such textured surfaces may be serrated surfaces or waved surfaces.

In yet another preferred embodiment, the shank engagement surface has a shank textured surface and the shank adjacent surface of the locking member has a locking member textured surface. In a more preferred embodiment, the shank textured surface and the locking member textured surface is a serrated surface or a waved surface. Such shank textured surface and locking member textured surface may also interlock.

In an additional preferred embodiment, the shank engagement surface is inclined such that when the shank portion is in the tool holder bore of the support block a wedge pocket is defined between the shank engagement surface and the bore interior surface such that the locking member may be forced into the wedge pocket so as to frictionally retain the shank portion of the cutting tool holder within the tool holder bore.

In an alternative embodiment, the excavation cutting tool holder retention assembly includes a support block, a cutting tool holder, and a locking member. The support block has tool holder bore, the tool holder bore having a bore interior surface. The cutting tool holder has a shank portion, the shank portion having a shank engagement surface and a shank end. The shank engagement surface is inclined such that when the shank portion is in the tool holder bore of the support block a wedge pocket is defined between the shank engagement surface and the bore interior surface. The locking member has a wedge portion, the wedge portion having a shank adjacent surface and a bore adjacent surface. At least one of the shank adjacent surface and shank engagement surface has a textured surface, the wedge portion of the locking member being forced into the wedge pocket such that the bore adjacent surface of the locking member engages the bore interior surface of the tool holder bore and such that the shank engagement surface engages the shank adjacent surface so as to frictionally retain the shank portion of the cutting tool holder within the tool holder bore.

In a preferred embodiment, the shank engagement surface has a shank textured surface and the shank adjacent surface has a locking member textured surface. The shank textured surface and the shank adjacent surface may both be a serrated surface or a waved surface. Such shank textured surface and locking member textured surface may also interlock.

In each of these embodiments, the shank portion of the cutting tool holder may have a compressible surface which is compressed against the bore interior surface when the wedge portion of the locking member is forced between the bore interior surface and the shank engagement surface. In a more specific embodiment, the tool holder bore may have a bore recess and at least a portion of the compressible surface of the shank portion of the cutting tool holder may protrude into the bore recess when the wedge portion of the locking member is forced between the bore interior surface and the shank engagement surface.

Furthermore, in each of these embodiments, the locking member may have an exposed portion and the exposed portion may have a striking surface which may be struck so as to force the wedge portion of the locking member between the bore interior surface and the shank engagement surface or into the wedge pocket. The locking member may also have a prying shoulder which may be used to pry the locking member from between the bore interior surface and the shank engagement surface.

In yet another alternative embodiment, the excavation cutting tool holder retention assembly includes a support block, a cutting tool holder, and a locking member. The support block has a tool holder bore, the tool holder bore having a bore interior surface. The cutting tool holder has a shank portion, the shank portion having a shank engagement surface and a compressible surface. The locking member has a wedge portion, the wedge portion having a bore adjacent surface and a shank adjacent surface, the wedge portion being forced between the shank engagement surface and the bore interior surface such that the shank adjacent surface engages the shank engagement surface, the compressible surface is compressed against the bore interior surface, and such that the shank portion of the cutting tool holder is frictionally retained within the tool holder bore.

In a preferred embodiment, the shank engagement surface and the shank adjacent surface has a textured surface.

In another preferred embodiment, the shank engagement surface has a shank textured surface and the shank adjacent surface has a locking member textured surface. In a more specific embodiment, the shank textured surface and the locking member textured surface interlock.

In yet another preferred embodiment, the tool holder bore has a bore recess and at least a portion of the compressible surface protrudes into the bore recess when the wedge portion of the locking member is forced into the wedge pocket.

The present invention also includes an improved cutting tool holder for use with the support block and a locking member, the support block having a tool holder bore, the tool holder bore having a bore opening and a bore interior surface, the locking member having a wedge portion, the wedge portion having a bore adjacent surface and a shank adjacent surface, the shank adjacent surface being inclined relative to the bore adjacent surface. The improved cutting tool holder comprises an outer wear region and a shank portion. The shank portion has a shank engagement surface. The shank engagement surface is inclined such that when the shank portion is inserted into the tool holder bore of the support block a wedge pocket is defined between the shank engagement surface and the bore interior surface such that the wedge portion of the locking member may be forced into the wedge pocket between the bore interior surface and the shank engagement surface so that the shank adjacent surface engages the shank engagement, the bore adjacent surface engages the bore interior surface, and the shank portion is compressed within the tool holder bore, so as to frictionally retain the shank portion of the cutting tool holder within the tool holder bore.

In a preferred embodiment, the shank engagement surface is a shank textured surface. The shank textured surface may be a shank serrated surface or a shank waved surface.

In another preferred embodiment, the shank portion has a compressible surface which is compressed against the bore interior surface when the locking member is forced into the wedge pocket between the bore interior surface and the shank engagement surface.

The present invention also includes an improved locking member for use with a support block and a cutting tool holder, the support block having a tool holder bore, the tool holder bore having a bore opening and a bore interior surface, the cutting tool holder having an outer wear region and a shank portion, the shank portion having a shank engagement surface, the shank engagement surface being inclined such that when the shank portion is inserted into the tool holder bore of the support block a wedge pocket is defined between the shank engagement surface and the bore interior surface. The improved locking member comprises an exposed portion and a wedge portion. The wedge portion has a bore adjacent surface and a shank adjacent surface. The shank adjacent surface is inclined relative to the bore adjacent surface such that the wedge portion of the locking member may be forced into the wedge pocket between the bore interior surface and the shank engagement surface so that the shank adjacent surface engages the shank engagement surface, the bore adjacent surface engages the bore interior surface, and the shank portion is compressed within the tool holder bore, so as to frictionally retain the shank portion of the cutting tool holder within the tool holder bore.

In a preferred embodiment, the shank adjacent surface is a locking member textured surface. In a more specific embodiment, the locking member textured surface may be a member serrated surface or a member waved surface. In another preferred embodiment, the exposed portion has a striking surface and a prying shoulder.

The advantages resulting from this invention are numerous. For example, because the components are relatively simple in geometry, machining or milling costs typically associated with the manufacture of such components are less than typical.

Another advantage of this invention is that screws or lugs are not necessary to assemble the cutting tool holder with the support block. The locking member can be simply pushed or knocked into, and pulled or pried out of, the wedge pocket or from between the bore interior surface and the shank engagement surface so as to effect the retention or removal of the shank portion of the cutting tool holder from the tool holder bore of the support block.

Another advantage of this excavation cutting tool holder assembly is that by texturizing the surfaces of the components in contact, such as, by example, the shank adjacent surface and the shank engagement surface, the frictional engagement between the various components is augmented. Such frictional engagement is especially augmented when the surfaces are texturized in such a manner as to effect interlocking engagement between the components.

Another advantage of embodiments in which the locking member has a striking surface is that the striking surface allows the locking member to be struck to effect retention of the shank portion of the cutting tool holder within the tool holder bore of the support block.

In embodiments where the locking member has a prying shoulder, another advantage is that the prying shoulder allows the locking member to be removed from the wedge pocket through the use of any suitable prying tool.

In embodiments where the shank portion of the cutting tool holder includes a compressible surface, another advantage is that the compressible surface is compressed against the bore interior surface when the locking member is forced into the wedge pocket so as to more securely retain the shank portion of the cutting tool holder within the tool holder bore of the support block. This effect is increased in embodiments where the tool holder bore includes a bore recess such that when the locking member is forced into the wedge pocket the compressible surface is compressed so as to protrude into the bore recess and further retain the components together.

Further objects and advantages of this invention will be apparent from the following description, reference being had to the accompanying drawings in which embodiments of the present invention are shown.

BRIEF DESCRIPTION OF DRAWINGS

While an embodiment of the invention is illustrated, the particular embodiment shown should not be construed to limit the claims. It is anticipated that various changes and modifications may be made, and that various embodiments may be employed, without departing from the scope of this patent.

BEST MODE FOR CARRYING OUT THE INVENTION

Figure 1:
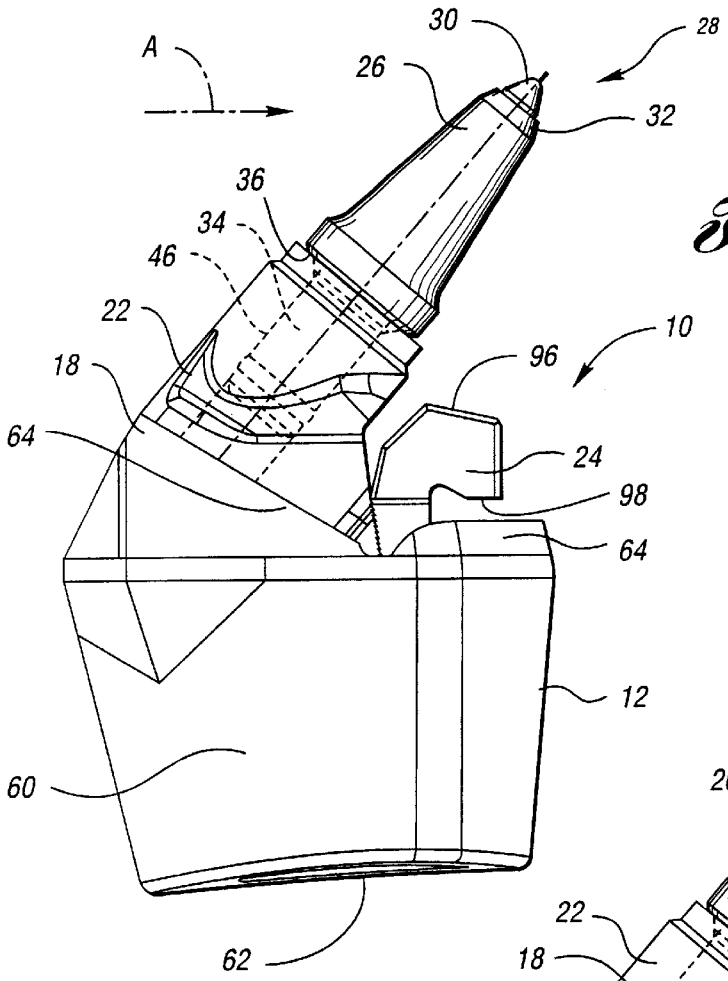
FIG. 1 is a side view of a cutting tool holder assembled with a support block showing one embodiment of the invention.

One embodiment of a cutting tool holder assembly 10 is shown in FIGS. 1–6. The cutting tool holder assembly 10 includes a support block 12 having a tool holder bore 14. The cutting tool holder assembly 10 also includes a cutting tool holder 18 having a shank portion 20 joined to an outer wear portion 22. The cutting tool holder assembly 10 further includes a locking member 24. As indicated in the embodiment shown, a cutting tool 26 may be rotatably and releasably mounted within the cutting tool holder 18. However, the scope of this patent covers cutting tool holder assemblies in which the cutting tool is mounted to the cutting tool holder in any manner, non-rotatably or otherwise.

In use, such support blocks 12 can be distributed over and fastened to, such as by welding or any other suitable method, the circumference and length of a drum or other body (not shown) according to any desired pattern. The drum or other body may be driven by any conventional or suitable power means to cause the cutting tools 26 to engage and break up material that they are applied to. Such applications are well known in the art, and will not be described in further detail here.

The cutting tool 26 typically has an elongated body. A cutting end 28 typically comprises a hard cutting insert 30 mounted onto a generally conical outer region 32. The hard cutting insert 30 may be made from cemented tungsten carbide or any other suitable material. The hard cutting insert 30 is generally mounted at the end of the conical outer region 32 where the hard cutting insert 30 may be brazed or otherwise suitably fastened into place. The cutting tool 26 also typically includes a cutting tool shank 34 adjoining a cutting tool shoulder 36 of the conical outer region 32. Because such cutting tools are generally known in the art, they will not be described in further detail here.

The cutting tool holder 18 may have a variety of configurations. The cutting tool holder 18 shown in this embodiment has the outer wear portion 22 and the shank portion 20 joined at a holder shoulder 44. The cutting tool holder 18 shown in this embodiment also defines a tool bore 46 in which the cutting tool 26 may be rotatably or otherwise mounted. Such rotatable or non-rotatable mountings are well known in the art, and will not be described in further detail here.

Figure 2:
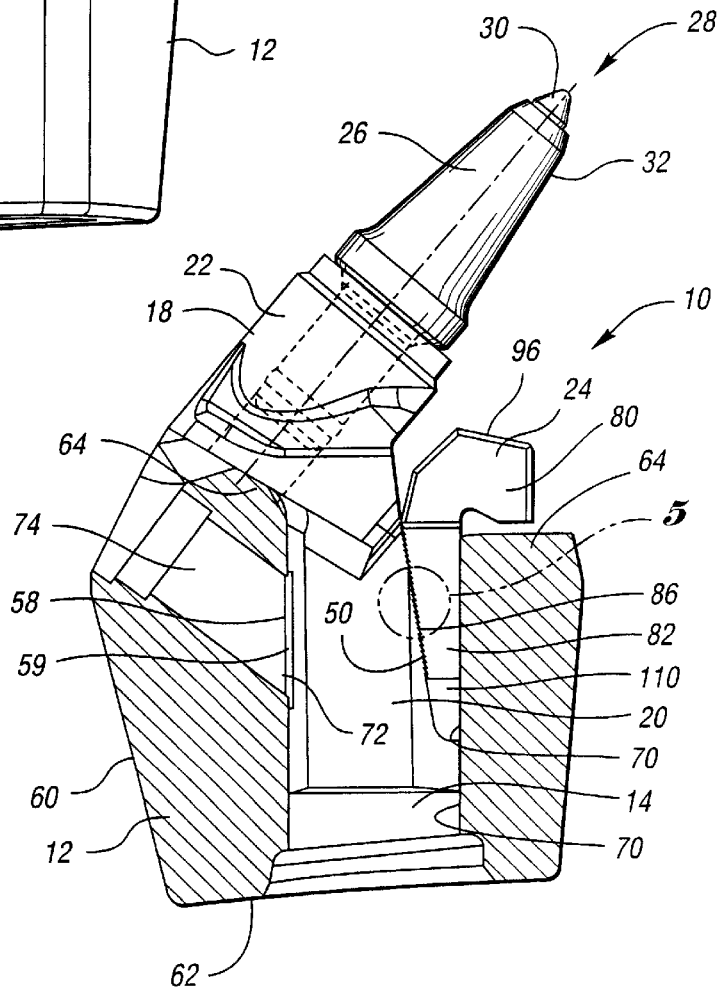
FIG. 2 is a side view identical to FIG. 1 except the support block is shown in cross-section.
Figure 3:
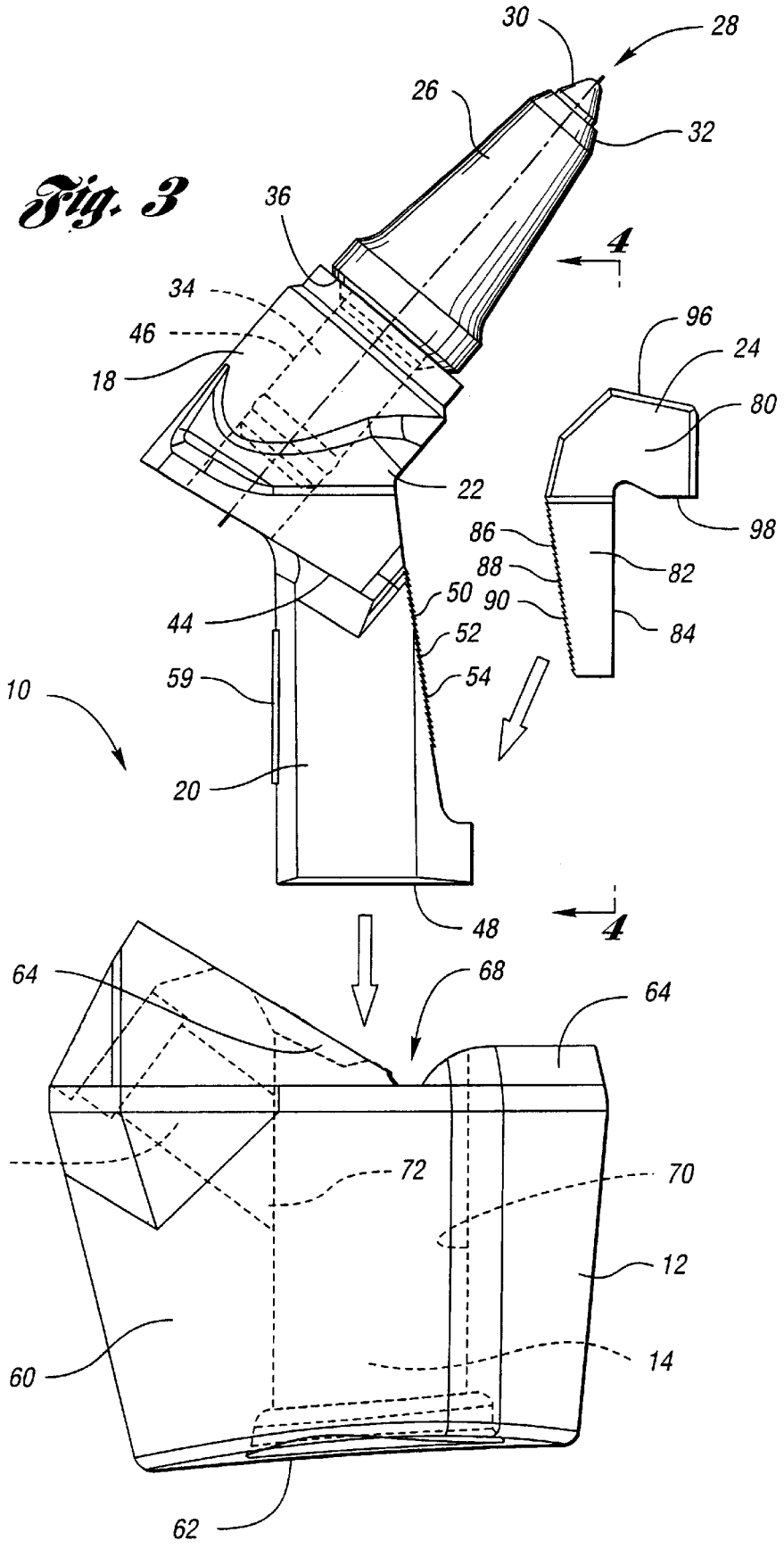
FIG. 3 is an exploded view of the embodiment shown in FIGS. 1 and 2.
Figure 4:
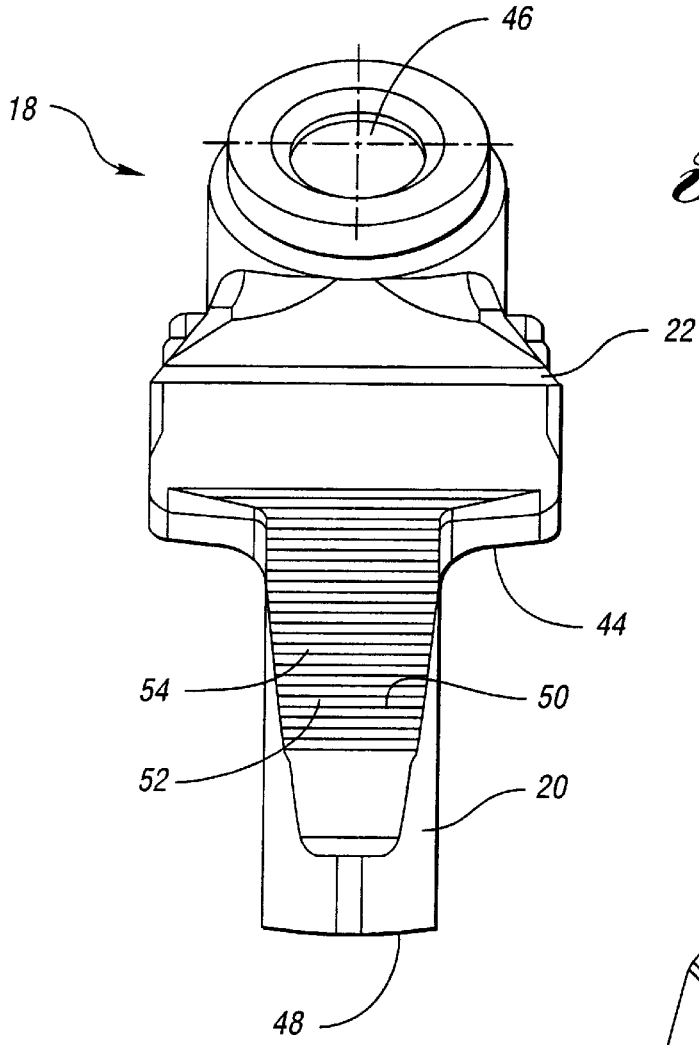
FIG. 4 is an elevational view of the cutting tool holder of the embodiment shown in FIGS. 1–3, viewed in the direction 4—4 indicated in FIG. 2.

The shank portion 20 of the cutting tool holder 18 may itself also have a variety of configurations. In this embodiment, as best shown in FIGS. 3 and 4, the shank portion 20 has a shank end 48 and a shank engagement surface 50. In this embodiment, as shown in FIG. 3, the engagement surface 50 is inclined relative to the remainder of the shank portion 20 such that the shank portion 20 is tapered inwardly from the shank end 48 to the holder shoulder 44. More specifically, as best shown in FIG. 2, the shank engagement surface 50 of this embodiment of the invention is inclined relative to the tool holder bore 14 when the shank portion 20 of the cutting tool holder 18 is inserted into the tool holder bore 14 of the support block 12.

Figure 6:
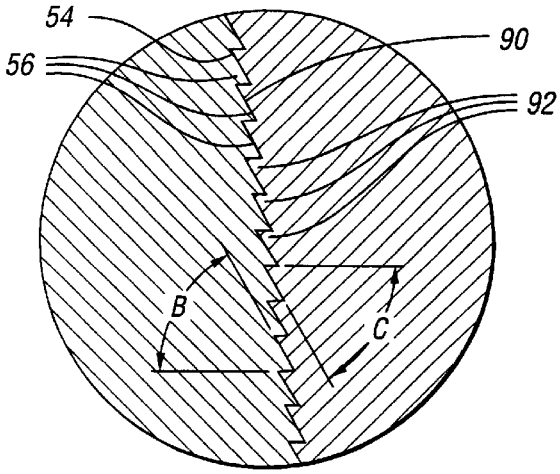
FIG. 6 is a magnified view of the portion indicated on FIG. 2.

As shown in FIGS. 1–4 and 6, at least a portion of the engagement surface 50 is a shank textured surface 52. In other words, the engagement surface 50 is not a smooth planar surface. More specifically, in this embodiment the shank textured surface 52 is a shank serrated surface 54. As best shown in FIGS. 3, 4 and 6, the shank serrated surface 54 preferably has a series of shank serrations 56, each of which is oriented toward the shank end 48. While any suitable serrations could be used, shank serrations 56 configured at an angle "B" of 60°, as indicated on FIG. 6, are believed suitable.

Figure 6A:
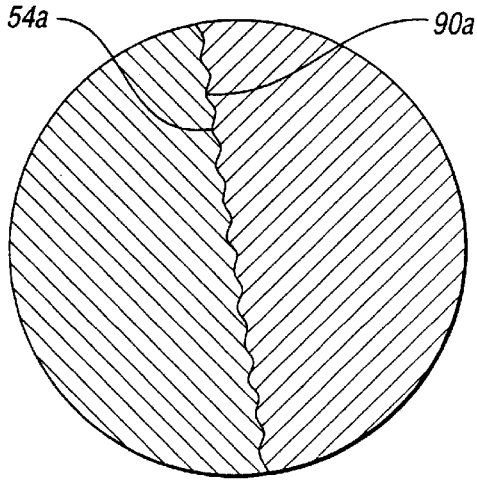
FIG. 6*a* is a magnified portion similar to that of FIG. 6 showing an alternative embodiment.

As shown in FIG. 6*a*, the shank textured surface 52 of an alternative embodiment is a shank waved surface 54*a*. Any other suitable shank textured surface 52, could also be used. While a textured surface is preferred, a smooth planar surface, such as the surface 54*c* shown in FIG. 6*c*, could also be used.

The shank portion 20 of the cutting tool holder 18 in this embodiment also includes a compressible surface 58. In this embodiment, the compressible surface 58 is located opposite the shank engagement surface 50 and consists of the outer surface of a compressible material 59 fastened to the shank portion 20. Any suitable material could be used as a compressible material 59 to define the compressible surface 58, such as any suitable rubber. Such compressible material 59 may be fastened to the shank portion 20 by press fitting as shown in FIGS. 2 and 3, or by using any suitable adhesive.

Like cutting tool holders, the support block 12 may have a variety of configurations. As shown in FIGS. 1–3, in this embodiment the support block 12 has a block side surface 60 and a block base 62 which may be mounted to a drum or other body (not shown) by welding or any other suitable method.

The tool holder bore 14 of such a support block 12 is typically surrounded by a seating shoulder region 64. The tool holder bore 14 defines a bore interior surface 70 and has a bore opening 68 intersecting the seating shoulder region 60. In this embodiment, the bore interior surface 70 also has a bore recess 72. As shown in FIGS. 2 and 3, in this embodiment the bore recess 72 is defined by a secondary bore 74 which intersects the tool holder bore 14.

The tool holder bore 14, and accordingly the cutting tool holder 18 and the cutting tool 26, is typically pitched in the direction of travel of the cutting tool 26, designated as direction "A" in FIG. 1.

Figure 5:
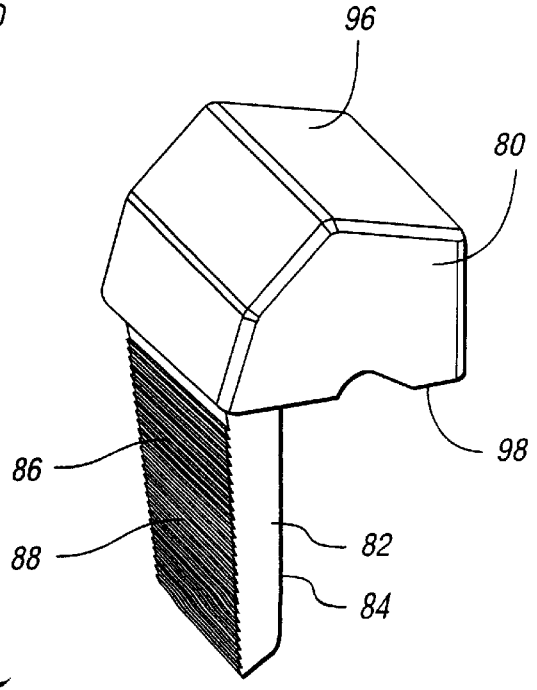
FIG. 5 is an isometric view of the locking member of the embodiment shown in FIGS. 1–3.

Like the cutting tool holder and support block, the locking member 24 may have a variety of configurations. As shown in FIGS. 1–3 and 5, the locking member 24 of this embodiment preferably has an exposed portion 80 and a wedge portion 82. The wedge portion 82 is that portion of the locking member 24 forced between the bore interior surface 70 and the shank engagement surface 50 when the components are assembled. As shown in FIGS. 2 and 3, the wedge portion 82 has a bore adjacent surface 84. As best shown in FIGS. 2 and 3, the bore adjacent surface 84 is the surface of the wedge portion 82 that is adjacent, and for the most part in contact with, the bore interior surface 70 when the components are assembled. The wedge portion 82 also has a shank adjacent surface 86. As best shown in FIGS. 2, 3, and 5, the shank adjacent surface 86 is that portion of the surface of the wedge portion 82 that is adjacent, and for the most part in contact with, the shank engagement surface 50 when the components are assembled.

As best shown in FIGS. 3 and 5 of this embodiment, at least a portion of the shank adjacent surface 86 is preferably a locking member textured surface 88. In other words, similar to the shank textured surface 52, a locking member textured surface 88 is not a smooth planar surface. More specifically, in this embodiment the locking member textured surface 88 is a member serrated surface 90. As best shown in FIGS. 3, 5, and 6, the member serrated surface 90 preferably has a series of member serrations 92, each of which is oriented toward the exposed portion 80 of the locking member 22. While any suitable serrations could be used, member serrations 92 configured as shown on FIG. 6, and having an angle "C" of 60°, are believed suitable.

Figure 6B:
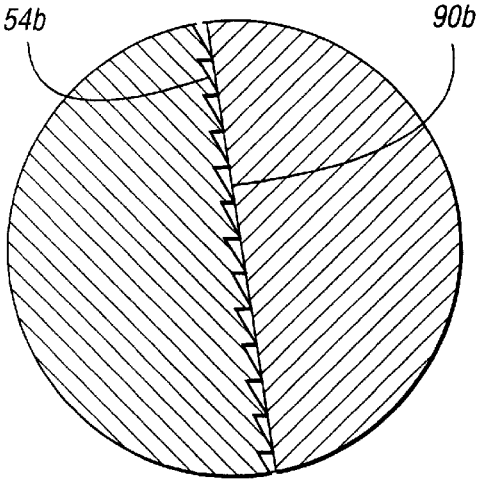
FIG. 6*b* is a magnified portion similar to that of FIG. 6 showing another alternative embodiment.

Any other suitable locking member textured surface 88, such as the member waved surface 90*a* shown as an alternative embodiment in FIG. 6*a* could be used. While a textured surface is preferred, a smooth planar surface, such as the surfaces 90*b* and 90*c* shown in FIGS. 6*b* and 6*c*, could also be used.

The shank adjacent surface 86 is preferably inclined relative to the bore adjacent surface 84 such that the wedge portion 82 of the locking member 22 is tapered into a wedge-like configuration such as that shown in FIG. 3. However, the wedge portion 82 could have any other suitable configuration, whether tapered or not.

As shown in FIGS. 1–3 and 5, the exposed portion 80 of the locking member 22 also preferably has a striking surface 96 having an orientation such that when struck the wedge portion 82 of the locking member 22 may be wedgingly forced into position as will be explained.

The exposed portion 80 of the locking member 22 also preferably has a prying shoulder 98 which, when the components are assembled as shown in FIG. 2, is located adjacent the seating shoulder region 64 surrounding the tool holder bore 14 of the support block 12.

To use the embodiments of this invention shown in FIGS. 1–6*c*, the shank portion 20 of the cutting tool holder 18, with or without the cutting tool 26, is inserted into the tool holder bore 14 of the support block 12 as shown in FIGS. 2 and 3. As shown in FIG. 2, the shank engagement surface 50 of the shank portion 20 of the cutting tool holder 18 and the bore interior surface 70 of the tool holder bore 14 define a wedge pocket 110. While the wedge pocket 110 in this embodiment is tapered, any suitable configuration could be used.

The wedge portion 82 of the locking member 22 is then non-threadably forced, by pushing, striking, or otherwise, into the wedge pocket 110 as shown in FIG. 2 such that the shank adjacent surface 86 frictionally engages the shank engagement surface 50 and the bore adjacent surface 84 frictionally engages the bore interior surface 70 so as to frictionally retain the shank portion 42 of the cutting tool holder 18 within the tool holder bore 14. This also serves to compress the shank portion of the cutting tool holder 18 against the bore interior surface 70 of the tool holder bore 14 so as to create frictional engagement between the shank portion 20 and the bore interior surface 70. The frictional engagement between the various components serves to retain the shank portion 20 of the cutting tool holder 18 within the tool holder bore 14 of the support block 12 during use.

In the embodiment shown in FIGS. 1–6, the frictional engagement between the shank adjacent surface 86 and the shank engagement surface 50 is augmented by the interlocking engagement effected by the interaction between the shank textured surface 52 and the locking member textured surface 88. More specifically as shown in FIGS. 2 and 5, such frictional engagement is augmented by the interlocking engagement between the shank serrations 56 of the shank serrated surface 54 and the member serrations 92 of the member serrated surface 90. The engagement is interlocking because, as shown in FIG. 2, after the components are assembled, the interlocking engagement between the shank textured surface 52 and the locking member textured surface 88 prevent movement between the shank portion 20 of the cutting tool holder 18 and the wedge portion 82 of the locking member 22 unless such components are loosened or at least partially withdrawn from the tool holder bore 14 of the support block 12, or alternatively, unless the shank textured surface 52 or the locking member textured surface 88 is deformed.

As shown in the alternative embodiment of FIG. 6*a*, the frictional engagement may alternatively be augmented by the interlocking engagement effected by the interaction between a shank waved surface 54*a* and a member waved surface 90*a*. Of course, such frictional engagement could be augmented by the interlocking engagement between any suitable shank textured surface and locking member textured surface.

Figure 6C:
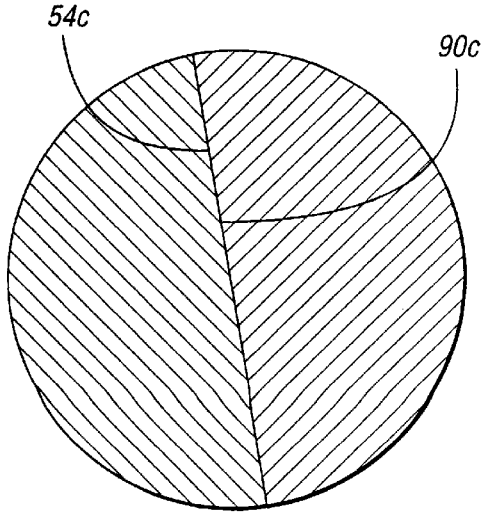
FIG. 6*c* is a magnified portion similar to that of FIG. 6 showing yet another alternative embodiment.

Furthermore, the frictional engagement may also be augmented by simply texturizing or roughening one or both of the shank adjacent surface 86 and the shank engagement surface 50, whether or not such an arrangement would effect an interlocking engagement. Similarly, frictional engagement between the shank adjacent surface 86 and the shank engagement surface 50 could also be augmented by simply texturizing one of the shank adjacent surface 86 and the shank engagement surface 50 in any suitable manner. For example, in accordance with another alternative embodiment shown in FIG. 6*b*, the frictional engagement between the shank engagement surface 50 and the shank adjacent surface 86 may be increased by utilizing a smooth shank adjacent surface 90*b* and a shank serrated surface 54*b*. While not shown, such frictional engagement could also be increased by utilizing a member serrated surface 90 with a smooth shank engagement surface 50, or by any other combination utilizing a textured surface together with a smooth surface. Of course, as shown in FIG. 6*c*, a smooth shank engagement surface 54*c* could also be used in conjunction with a smooth shank adjacent surface 90*c*.

While not shown, frictional engagement between the various components could also be augmented by texturizing, in an interlocking manner or otherwise, the shank portion 20 other than the shank engagement surface 50, the tool holder bore 14, or the bore adjacent surface 84 of the locking member 24. In such case, one or both of such surfaces in contact with each other could be texturized, in an interlocking manner or otherwise, to augment frictional engagement between the various components.

In the embodiment shown, when the wedge portion 82 of the locking member 22 is forced into the wedge pocket 110, the compressible surface 58 of the shank portion 20 of the cutting tool holder 18 is compressed against the bore interior surface. This further serves to increase the frictional engagement between the shank portion 20 of the cutting tool holder 18 and the tool holder bore 14 of the support block 12. Furthermore, as best shown in FIG. 2, when the tool holder bore 14 of the support block 12 includes a bore recess 72, and the components are assembled as shown, the compressible surface 58 of the shank portion 20 is forced to protrude into the bore recess 72, further locking the components together.

In order to increase the frictional engagement between the components, the wedge portion 82 of the locking member 22 may be non-threadably forced into the wedge pocket 110 by striking the striking surface 96 with a suitable tool such as a hammer (not shown).

When it desired to change the cutting tool holder 18, a prying tool (not shown) is placed between the prying shoulder 98 of the locking member 22 and the seating shoulder region 64 of the support block 12 and manipulated so as to pry the locking member 22 from the wedge pocket 110. When the locking member 22 is loose, it may then be simply removed from the wedge pocket 110. The shank portion 20 of the cutting tool holder 18 may then be removed from the tool holder bore 14 of the support block 12.

One advantage of this excavation cutting tool holder assembly is that no screws or lugs are required to assemble the cutting tool holder 18 with the support block 12. The locking member 24 can be simply pushed or knocked into, and pulled or pried out of, the wedge pocket 110 so as to effect the retention or removal of the shank portion 20 of the cutting tool holder 18 within or from the tool holder bore 14 of the support block 12. A related advantage is that because the components are relatively simple in geometry, machining or milling costs typically associated with the manufacture of such components are less than typical.

Another advantage of this excavation cutting tool holder assembly is that by texturizing the surfaces of components in contact after assembly, such as the shank adjacent surface 86 and the shank engagement surface 50, the frictional engagement between the various components is augmented. Such frictional engagement is especially augmented when the surfaces are texturized in such a manner as to effect interlocking engagement between the components, such as when a shank serrated surface 54 and member serrated surface 90 is used.

Another advantage of embodiments in which the locking member 22 has a striking surface 96 is that the striking surface 96 allows the locking member 22 to be struck to effect retention of the shank portion 20 of the cutting tool holder 18 within the tool holder bore 14 of the support block 12.

In embodiments where the locking member 22 has a prying shoulder 98, another advantage is that the prying shoulder 98 allows the locking member 22 to be removed from the wedge pocket 110 through the use of any suitable prying tool (not shown).

In embodiments where the shank portion 42 of the cutting tool holder 18 includes a compressible surface 58, another advantage is that the compressible surface 58 is compressed against the bore interior surface 70 when the locking member 22 is forced into the wedge pocket 110 so as to more securely retain the shank portion 42 of the cutting tool holder 18 within the tool holder bore 14 of the support block 12. This effect is increased in embodiments where the tool holder bore 14 includes a bore recess 72 such that when the locking member 22 is forced into the wedge pocket 110 the compressible surface 58 is compressed so as to protrude into the bore recess 72 and further retain the components together.

While particular embodiments of the invention have been illustrated and described, it will be obvious to those skilled in the art that various changes and modifications may be made, and other embodiments utilized, without departing from the scope of this patent. It is intended that the following claims cover all such modifications and embodiments, and all other modifications and embodiments, and all equivalents of such modifications and embodiments, that fall within the spirit of this invention.

What is claimed is:

1. An excavation cutting tool holder retention assembly comprising:

a support block having a tool holder bore, the tool holder bore having a bore interior surface;

a cutting tool holder having a tool bore and a shank portion disposable in the tool holder bore, the shank portion having a shank engagement surface; a cutting tool disposable in the tool bore; and a locking member non-threadably forceable between the bore interior surface and the shank engagement surface so as to frictionally retain the shank portion of the cutting tool holder within the tool holder bore.

2. The excavation cutting tool holder retention assembly of claim 1 wherein the locking member has a wedge portion, the wedge portion having a bore adjacent surface and a shank adjacent surface, and at least one of the bore adjacent surface, shank adjacent surface, shank portion, and bore interior surface has a textured surface.

3. The excavation cutting tool holder retention assembly of claim 2 wherein the textured surface is a serrated surface.

4. The excavation cutting tool holder retention assembly of claim 2 wherein the textured surface is a waved surface.

5. The excavation cutting tool holder retention assembly of claim 1 wherein the locking member has a wedge portion, the wedge portion having a bore adjacent surface and a shank adjacent surface, and at least two of the bore adjacent surface, shank adjacent surface, shank portion, and bore interior surface which are engageable with each other have a textured surface.

6. The excavation cutting tool holder retention assembly of claim 5 wherein the textured surfaces are interlockable.

7. The excavation cutting tool holder retention assembly of claim 5 wherein the textured surfaces are serrated surfaces.

8. The excavation cutting tool holder retention assembly of claim 5 wherein the textured surfaces are waved surfaces.

9. The excavation cutting tool holder retention assembly of claim 5 wherein the shank engagement surface has a shank textured surface and the shank adjacent surface of the locking member has a locking member textured surface.

10. The excavation cutting tool holder retention assembly of claim 9 wherein the shank textured surface and the locking member textured surface are interlockable.

11. The excavation cutting tool holder retention assembly of claim 9 wherein the shank textured surface and the locking member textured surface is a serrated surface.

12. The excavation cutting tool holder retention assembly of claim 9 wherein the shank textured surface and the locking member textured surface is a waved surface.

13. The excavation cutting tool holder retention assembly of claim 1 wherein the shank engagement surface is inclined such that when the shank portion is in the tool holder bore of the support block a wedge pocket is defined between the shank engagement surface and the bore interior surface such that the locking member may be forced into the wedge pocket so as to frictionally retain the shank portion of the cutting tool holder within the tool holder bore.

14. The excavation cutting tool holder retention assembly of claim 1 wherein the shank portion of the cutting tool holder has a compressible surface which is compressed against the bore interior surface when the locking member is forced between the bore interior surface and the shank engagement surface.

15. The excavation cutting tool holder retention assembly of claim 14 wherein the tool holder bore has a bore recess and at least a portion of the compressible surface of the shank portion of the cutting tool holder protrudes into the bore recess when the shank portion is disposed in the tool holder bore and the locking member is forced between the bore interior surface and the shank engagement surface.

16. The excavation tool holder retention assembly of claim 14 wherein the support block has an additional bore that intersects the tool holder bore, the additional bore defining a bore recess, and wherein at least a portion of the compressible surface protrudes into the bore recess when the shank portion is disposed in the tool holder bore and the locking member is forced between the bore interior surface and the shank engagement surface.

17. The excavation cutting tool holder retention assembly of claim 1 wherein the locking member has an exposed portion and the exposed portion has a striking surface which may be struck so as to force the locking member between the bore interior surface and the shank engagement surface.

18. The excavation cutting tool holder retention assembly of claim 1 wherein the locking member has a prying shoulder which may be used to pry the locking member from between the bore interior surface and the shank engagement surface.

19. An excavation cutting tool holder retention assembly comprising:

a support block having a tool holder bore, the tool holder bore having a bore opening and a bore interior surface;

a cutting tool holder having a tool bore and a shank portion, the shank portion being insertable through the bore opening and into the tool holder bore, the shank portion having a shank engagement surface and a shank end, the shank engagement surface being inclined such that when the shank portion is in the tool holder bore of the support block a wedge pocket is defined between the shank engagement surface and the bore interior surface; a cutting tool disposable in the tool bore; and a locking member having a wedge portion, the wedge portion having a shank adjacent surface and a bore adjacent surface, at least one of the shank adjacent surface and shank engagement surface has a textured surface, wherein when the shank portion is in the tool holder bore, the wedge portion of the locking member is insertable through the bore opening and non-threadably forceable into the wedge pocket such that the bore adjacent surface of the locking member engages the bore interior surface of the tool holder bore and such that the shank engagement surface engages the shank adjacent surface so as to frictionally retain the shank portion of the cutting tool holder within the tool holder bore.

20. The excavation cutting tool holder retention assembly of claim 19 wherein the shank engagement surface has a shank textured surface and the shank adjacent surface has a locking member textured surface.

21. The excavation cutting tool holder retention assembly of claim 20 wherein the shank textured surface interlocks with the locking member textured surface when the shank portion is in the tool holder bore and the locking member is forced into the wedge pocket.

22. The excavation cutting tool holder retention assembly of claim 20 wherein the shank textured surface is a shank serrated surface and the locking member textured surface is a member serrated surface.

23. The excavation cutting tool holder retention assembly of claim 20 wherein the shank textured surface is a shank waved surface and the locking member textured surface is a member waved surface.

24. The excavation cutting tool holder retention assembly of claim 19 wherein the shank portion of the cutting tool holder has a compressible surface which is compressed against the bore interior surface when the wedge portion of the locking member is forced between the bore interior surface and the shank engagement surface.

25. The excavation cutting tool holder retention assembly of claim 24 wherein the tool holder bore has a bore recess and at least a portion of the compressible surface of the shank portion of the cutting tool holder protrudes into the bore recess when the wedge portion of the locking member is forced between the bore interior surface and the shank engagement surface.

26. The excavation tool holder retention assembly of claim 24 wherein the support block has an additional bore that intersects the tool holder bore, the additional bore defining a bore recess, and wherein at least a portion of the compressible surface protrudes into the bore recess when the wedge portion of the locking member is forced between the bore interior surface and the shank engagement surface.

27. The excavation cutting tool holder retention assembly of claim 19 wherein the locking member has an exposed portion and the exposed portion has a striking surface which may be struck so as to force the wedge portion of the locking member into the wedge pocket.

28. The excavation cutting tool holder retention assembly of claim 19 wherein the locking member has a prying shoulder which may be used to pry the locking member from between the bore interior surface and the shank engagement surface.

29. An excavation cutting tool holder retention assembly comprising:

a support block having a tool holder bore, the tool holder bore having a bore interior surface;

a cutting tool holder having a tool bore and a shank portion disposable in the tool holder bore, the shank portion having a shank engagement surface and a compressible surface; a cutting tool disposable in the tool bore; and a locking member having a wedge portion, the wedge portion having a shank adjacent surface, the wedge portion being forceable between the shank engagement surface and the bore interior surface such that the shank adjacent surface engages the shank engagement surface, the compressible surface is compressed against the bore interior surface, and such that the shank portion of the cutting tool holder is frictionally retained within the tool holder bore.

30. The excavation cutting tool holder retention assembly of claim 29 wherein at least one of the shank engagement surface and the shank adjacent surface has a textured surface.

31. The excavation cutting tool holder retention assembly of claim 29 wherein the shank engagement surface has a shank textured surface and the shank adjacent surface has a locking member textured surface.

32. The excavation cutting tool holder retention assembly of claim 31 wherein the shank textured surface and the locking member textured surface interlock when the shank portion is disposed in the tool holder bore and the wedge portion is forced between the shank engagement surface and the bore interior surface.

33. The excavation cutting tool holder retention assembly of claim 29 wherein the tool holder bore has a bore recess and at least a portion of the compressible surface protrudes into the bore recess when the wedge portion of the locking member is forced between the shank engagement surface and the bore interior surface.

34. The excavation cutting tool holder retention assembly of claim 33 wherein the shank engagement surface is a shank textured surface and the shank adjacent surface is a locking member textured surface.

35. The excavation cutting tool holder retention assembly of claim 34 wherein the shank textured surface and the locking member textured surface interlock when the shank portion is disposed in the tool holder bore and the wedge portion is forced between the shank engagement surface and the bore interior surface.

36. The excavation tool holder retention assembly of claim 29 wherein the support block has an additional bore that intersects the tool holder bore, the additional bore defining a bore recess, and wherein at least a portion of the compressible surface protrudes into the bore recess when the wedge portion of the locking member is forced between the shank engagement surface and the bore interior surface.

37. An excavation cutting tool holder retention assembly comprising:

a support block including a tool holder bore having a bore opening and a bore interior surface, the support block further having an additional bore that intersects the tool holder bore and defines a bore recess;

a cutting tool holder having a tool bore and a shank portion, the shank portion having a shank engagement surface and a compressible surface, the shank portion being insertable through the bore opening and into the tool holder bore;

a cutting tool disposable in the tool bore; and a locking member insertable through the bore opening when the shank portion is in the tool holder bore, and being forceable between the bore interior surface and the shank engagement surface so as to frictionally retain the shank portion of the cutting tool holder within the tool holder bore;

wherein at least a portion of the compressible surface protrudes into the bore recess when the locking member is forced between the bore interior surface and the shank engagement surface.

* * * * *